United States Patent [19]

Klopotek et al.

[11] Patent Number: 5,043,636

[45] Date of Patent: Aug. 27, 1991

[54] HIGH VOLTAGE SWITCH

[75] Inventors: Peter J. Klopotek, Framingham; Timothy J. Bell, Boston, both of Mass.

[73] Assignee: Summit Technology, Inc., Waltham, Mass.

[21] Appl. No.: 387,512

[22] Filed: Jul. 28, 1989

[51] Int. Cl.[5] ..... H01J 17/04; H01J 17/20; H01J 17/30

[52] U.S. Cl. ..... 315/335; 315/337; 315/184; 315/198; 313/217; 313/595; 313/596

[58] Field of Search ..... 315/335, 337, 35; 313/595, 596, 597, 602, 603

[56] References Cited

U.S. PATENT DOCUMENTS

| | | | |
|---|---|---|---|
| 3,030,547 | 4/1962 | Dike | 313/595 |
| 3,141,111 | 7/1964 | Godlove | 315/181 |
| 3,398,322 | 8/1968 | Guenther | 315/150 |
| 3,510,716 | 5/1970 | Carter | 313/147 |
| 3,551,677 | 12/1970 | Brewster | 250/93 |
| 3,659,225 | 4/1972 | Furumoto et al. | 332/7.51 |
| 3,798,484 | 3/1974 | Rich | 313/603 |
| 4,035,683 | 7/1977 | Hasson | 313/595 |
| 4,198,590 | 4/1980 | Harris | 315/335 |
| 4,401,920 | 8/1983 | Taylor et al. | 315/150 |
| 4,484,106 | 11/1984 | Taylor et al. | 315/150 |
| 4,490,651 | 12/1984 | Taylor et al. | 315/150 |
| 4,563,608 | 1/1986 | Lawson et al. | 313/231.71 |
| 4,755,719 | 7/1988 | Limpaecher | 313/595 |
| 4,935,666 | 6/1990 | McCann | 313/595 |

FOREIGN PATENT DOCUMENTS

| | | |
|---|---|---|
| 612324 | 5/1978 | U.S.S.R. . |
| 748607 | 7/1980 | U.S.S.R. . |

*Primary Examiner*—Eugene R. LaRoche
*Assistant Examiner*—Son Dinh
*Attorney, Agent, or Firm*—Thomas J. Engellenner

[57] ABSTRACT

The present invention encompasses a high voltage switch utilizing first and second terminal electrodes and an intermediate electrode disposed therebetween. A high voltage pulse, applied to the intermediate electrode, initiates sequential overvoltaging of the region between one of the terminal electrodes and the intermediate electrode and, then between the intermediate electrode and the other electrode; thereby permitting electrical current to flow between the terminal electrodes. The geometry of the electrodes is chosen so as to yield a field enhancement factor between each region which is sufficiently low to permit highly reliable, predictable, and controllable sequential electrical breakdown.

36 Claims, 3 Drawing Sheets

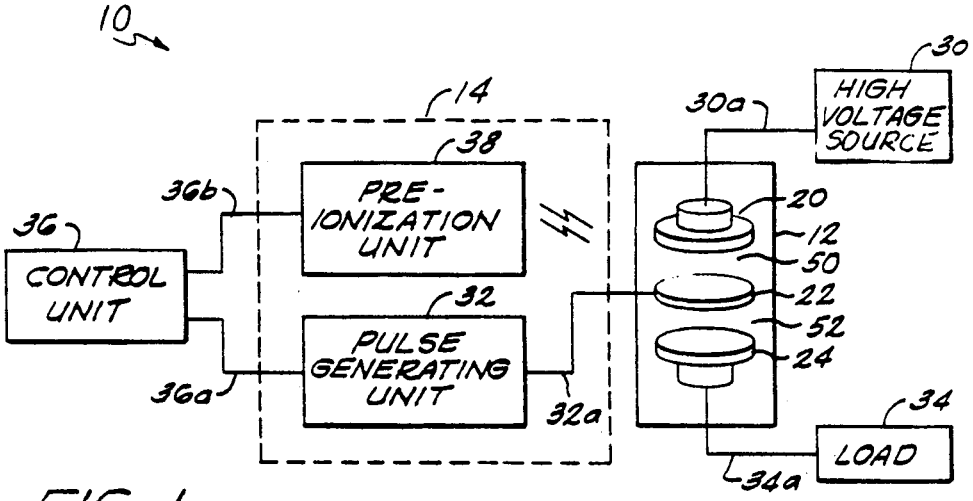
FIG. 1
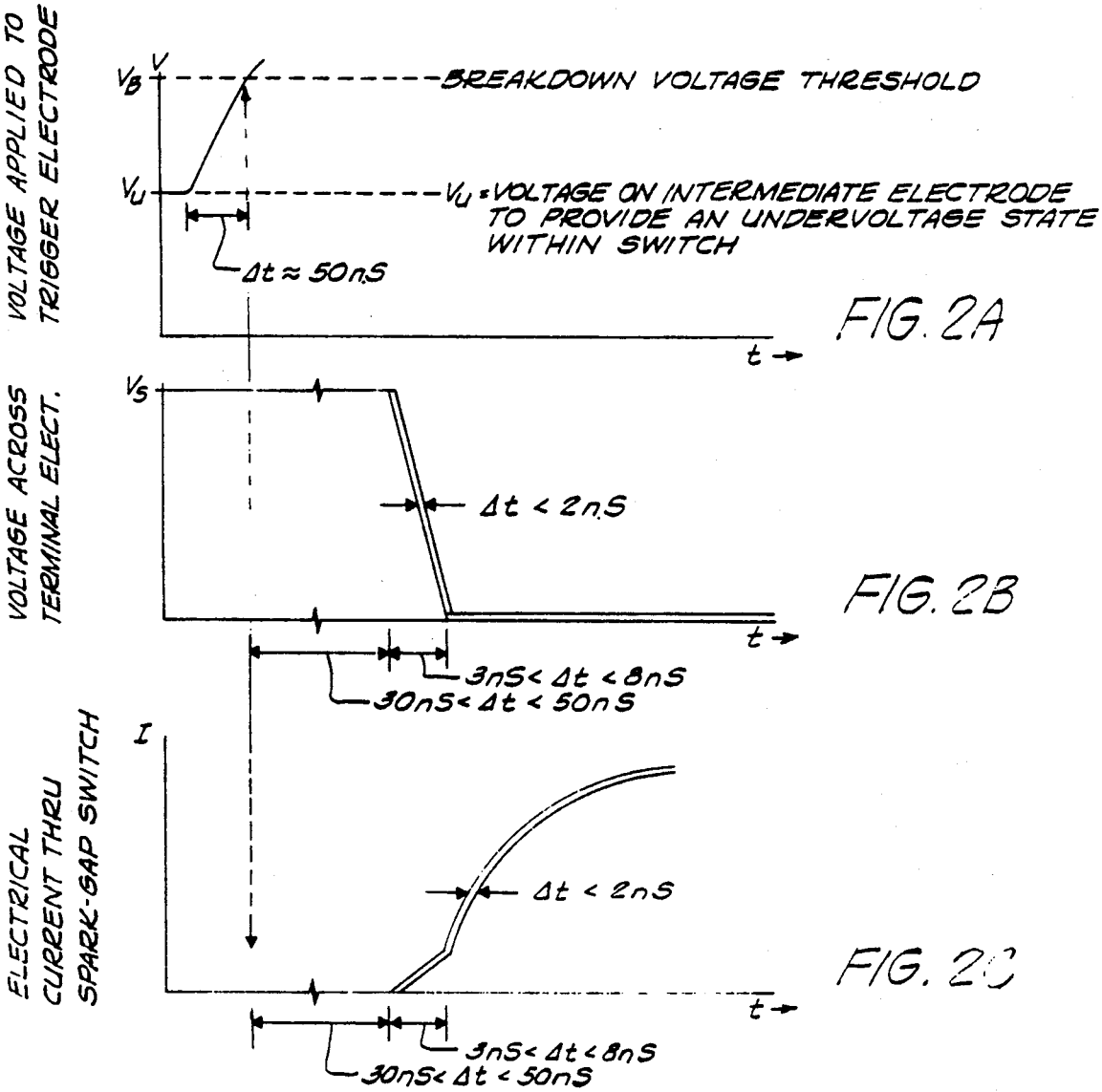

HIGH VOLTAGE SWITCH

BACKGROUND OF THE INVENTION

The technical field of the invention is high voltage switching devices and, in particular, high reliability spark gap switches.

Spark gap switches are devices which transfer energy, generally from a power source to a load, utilizing a plasma discharge. In such plasma discharge devices, the medium between the terminal electrodes is excited to induce an electron avalanche within the medium. An ionization path or plasma channel forms within the medium bridging the terminal electrodes and thus collapsing the voltage differential between the terminal electrodes.

Many conventional spark-gap switches tend to experience large jitter, leading to an unreliable and unpredictable switching behavior. Generally, this problem appears to be the result of the geometry of the terminal electrodes in such switches. Often, spark gap switches employ sharp pointed electrodes, which concentrate the electric field and result in a degradation of the breakdown process. Moreover, such spark gap switches are more susceptible to deterioration due to electrode erosion, and consequently have relatively short lifetimes.

There exists a need for better high power switches having greater controllability, predictability, and reliability. There also exists a need for high power switches particularly spark-gap switches and the like providing low jitter (less than 10 nanoseconds) and higher repetition firing rates (greater than 100 Hz). Furthermore, a switch having lower overvoltaging requirements (less than 50%), being substantially insensitive to reverse currents, and yielding an increase in the electrode life would satisfy a substantial need in the art.

SUMMARY OF THE INVENTION

The present invention encompasses a high voltage switch utilizing first and second terminal electrodes and an intermediate electrode disposed therebetween. A high voltage pulse, applied to the intermediate electrode, initiates sequential overvoltaging of the region between one of the terminal electrodes and the intermediate electrode and, then between the intermediate electrode and the other electrode; thereby permitting electrical current to flow between the terminal electrodes. The geometry of the electrodes is chosen so as to yield a field enhancement factor between each region which is sufficiently low to permit highly reliable, predictable, and controllable sequential electrical breakdown.

In an illustrative embodiment of this invention, the electrodes have substantially identical geometries and are configured in a substantially parallel and equally spaced relationship to each other, to provide a field enhancement factor between each electrode pair that is less than or equal to about 1.2 and, preferably, less than or equal to 1.1. In addition, the electrodes preferably have an active surface area greater than 25 $cm^2$. The field enhancement factor is defined as the ratio of maximum electrical field strength in the active region between the electrodes to average electrical field strength prior to switch breakdown.

In accordance with another aspect of the invention, a system comprising of an array of first and second terminal electrodes arranged in pairs and having all the first terminal electrodes electrically connected in parallel and all the second terminal electrodes electrically connected in parallel and at least one intermediate electrode disposed between the first and second terminal electrodes is utilized to deliver a high voltage and high current from a high voltage source to a load. The reliability and controllability of the plasma discharge, through the overvoltaging process, allows each electrode pair to discharge concurrently, and thereby transmit electrical current in parallel. Each first and second electrode pair in the array, transports a current, nearly simultaneously and in parallel, to deliver a substantially higher current to the load than could be achieved with a single switch.

Potential uses of the present invention include systems requiring a very rapid transfer of energies in the decajoule to kilojoule range having repetition rates in the range of 1 to 200 Hz. Specific uses include laser systems, such as TEA lasers, plasma pinch devices, and crowbar systems. The high voltage high power switch system can be tailored to the specific power and repetition rate requirements of the load; the array of electrode pairs may be expanded or contracted to achieve and satisfy the current or the power constraints of a particular load.

The present invention is particularly useful in laser systems when a high voltage, high current pulse is required to initiate lasing with a medium in a laser head assembly. The rapid, highly reliable, predictable, and controllable transfer of energy by the switch to a, or in a laser system creates an excitation environment within the laser medium and thus induces lasing in the medium. Furthermore, the high voltage switches of the present invention are substantially insensitive to reverse currents and accidental misfiring, and therefore, can be incorporated directly into power conditioning systems without the need for physical separators or careful matching of the electrical characteristics of the circuits.

The invention will next be described in connection with certain preferred embodiments; however, it should be clear that various changes and modifications can be made without departing from the spirit or scope of the invention. For example, although the illustrated switch elements each have a single intermediate electrode to initiate discharge, it should be clear that alternative triggering mechanisms can be employed including, for example, a plurality of intermediate electrodes stacked or otherwise disposed between the terminal electrodes. Additionally, when two or more switch elements of the present invention are employed in conjunction with each other to form a parallel gap switch system as illustrated below, the system can also include various auxiliary electrical components, including both AC and DC coupling and decoupling inductance and capacitance elements, and delay networks (including resistive, capacitive and inductive elements) to insure substantially simultaneous current transfer and/or to otherwise enhance performance.

BRIEF DESCRIPTION OF THE DRAWINGS

FIG. 1 is a schematic block diagram of a high voltage spark gap switch system according to the invention;

FIG. 2A, 2B, and 2C are timing diagrams correlating the waveform of the high voltage "trigger" pulse applied to the intermediate electrode to initiate sequential electrical breakdown between the regions, the voltage differential between the terminal electrodes, and the electrical current flow between the terminal electrodes, respectively;

DETAILED DESCRIPTION

Figure 3:
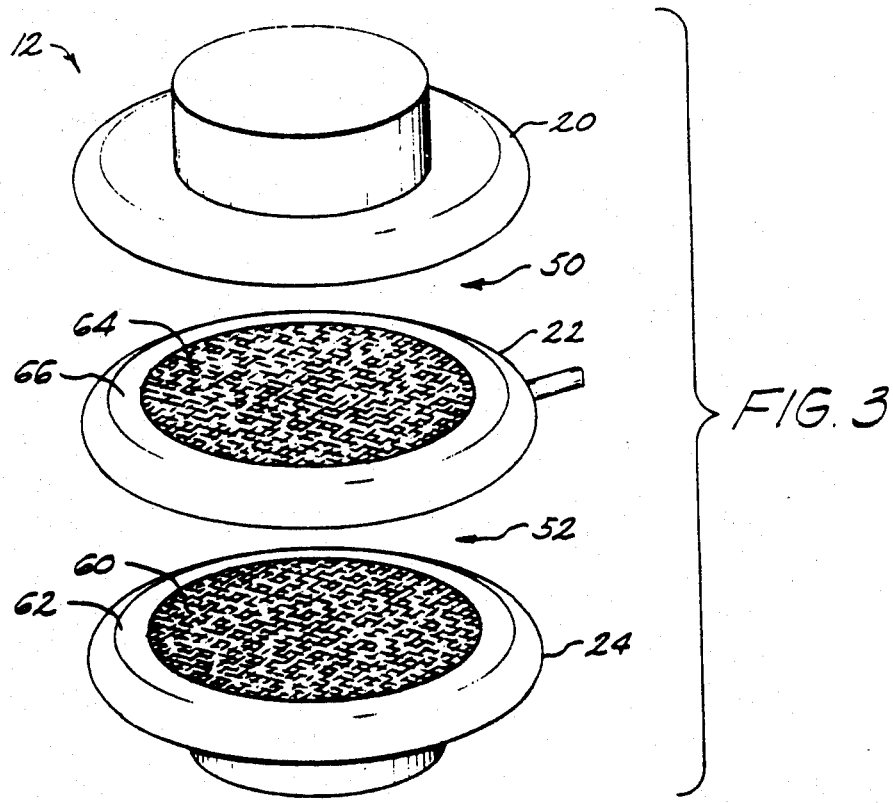
FIG. 3 is a more detailed prospective view of the terminal and intermediate electrodes of the spark gap switch of FIG. 1.

In FIG. 1 a high voltage switch system 10, according to the present invention, is illustrated by a simplified electrical schematic diagram. System 10 includes a spark-gap switch 12, trigger unit 14, a high voltage source 30, an electrical load 34 and a control unit 36.

Spark-gap switch 12 includes two terminal electrodes 20 and 24, and an intermediate electrode 22 disposed between terminal electrodes 20 and 24. Terminal electrode 20 is electrically connected, via line 30*a*, to high voltage source 30. The other terminal electrode 24 is electrically connected, via line 34*a*, to load 34.

Trigger unit 14 includes the pulse generating unit 32 and preionization unit 38, for example, an ultra violet radiation source. Pulse generating unit 32 is electrically connected via lines 32*a* to intermediate electrode 22 of switch 12. Pulse generating unit 32 is also electrically connected, via line 36*a*, to control unit 36. Preionization unit 38 is also electrically connected, via line 36*b*, to control unit 36.

In operation, system 10 utilizes pulse generating unit 32 to initiate sequential breakdown of the medium within regions 50 and 52; thus collapsing the voltage differential between terminal electrodes 20 and 24. As a result, electrical current flows from source 30 to load 34.

In particular, control unit 36 applies a signal on line 36*a* to command pulse generating unit 32 to generate a high voltage impulse. Pulse generating unit 32 applies the high voltage impulse on line 32*a* which, depending upon the "polarity" of the high voltage impulse, increases or decreases the electrical potential at intermediate electrode 22. Application of the high voltage impulse causes a redistribution of the electric fields between terminal electrode 20 and intermediate electrode 22, and terminal electrodes 24 and intermediate electrode 22; consequently causing sequential overvoltaging of the working gas within regions 50 and 52. Once the working gas in each region is sequentially overvoltaged, the working gas breaks down and the voltage differential between terminal electrodes 20 and 24 collapses and an electrical path establishes whereby electrical current flows between terminal electrodes 20 and 24, from source 30 to load 34.

Prior to initiating plasma discharge, the electrical potential on intermediate electrode 22 is controlled by control unit 36 through pulse generating unit 32 to prevent the "triggering" of switch 12. Pulse generating unit 32 confines the electrical potential at intermediate electrode 22 to a level such that regions 50 and 52 remain in an undervoltage state; a condition whereby the electrical potentials between regions 50 and 52 are confined below the static breakdown voltage and whereby the environment within regions 50 and 52 fail to satisfy the requirements for initiating plasma discharge.

If the terminal electrodes 20 and 24, and intermediate electrode 22 have substantially identical geometries and electrodes 20, 22, and 24 are configured in an equally spaced relationship, intermediate electrode 22 is confined at a electrical potential of approximately one-half the potential difference between terminal electrodes 22 and 24. As a result, the electrical potential at the intermediate electrode creates an electric field that is evenly distributed between terminal electrode 20 and intermediate electrode 22, and terminal electrode 24 and intermediate electrode 22. (When the electrodes are not equally spaced or do not have substantially identical geometries, the potential on the intermediate electrode, will, of course, be different.)

The polarity of the trigger pulse dictates the sequence of the overvoltaging process. When system 10 is configured such that terminal electrode 20 is at a higher electrical potential than terminal electrode 24, then a high voltage impulse which increases the voltage at intermediate electrode 22 (positive polarity) causes a breakdown of region 52 between terminal electrode 24 and intermediate electrode 22 prior to region 50 between terminal electrode 20 and intermediate electrode 22. Conversely, a high voltage impulse which decreases the voltage at intermediate electrode 22 (negative polarity) causes a breakdown of region 50 between terminal electrode 20 and intermediate electrode 22 prior to region 52 between terminal electrode 24 and intermediate electrode 22.

For example, upon application of a positive trigger pulse, on line 32*a*, to intermediate electrode 22, the electric fields between terminal electrodes 20 and 24, and intermediate electrode 22 redistribute. The voltage differential in region 50 between terminal electrode 20 and intermediate electrode 22 is reduced and consequently the voltage differential between intermediate electrode 22 and terminal electrode 24 is increased. The increase in the voltage differential between intermediate electrode 22 and terminal electrode 24 forces region 52 into an overvoltaged state; thus initiating plasma discharge between the intermediate electrode 22 and terminal electrode 24. As a result of the breakdown of the medium within region 52, the voltage differential between intermediate electrode 22 and terminal electrode 24 substantially decreases and, consequently the voltage differential between terminal electrode 20 and intermediate electrode 22 substantially increases; thus forcing region 50 into an overvoltage state. Forcing region 50 into an overvoltage state, causes the voltage differential between terminal electrode 20 and intermediate electrode 22 to collapse. As a result, a conductive plasma channel is formed, between terminal electrodes 20 and 24, whereby electrical current flows from voltage source 30 to load 34.

Illustrated in FIG. 2A, 2B, and 2C is a timing diagram of the "switching" process. FIG. 2A depicts a positive polarity trigger pulse that is applied to the intermediate electrode and which "triggers" the overvoltaging sequence. After the voltage applied to the intermediate electrode crosses the breakdown voltage threshold ($V_B$) the working gas within regions 50 and 52 sequentially begin to breakdown.

Illustrated in FIG. 2B is a waveform depicting the voltage across terminal electrodes 20 and 24, in response to a trigger pulse applied to intermediate electrode 22. This voltage waveform is correlated in time with the trigger pulse waveform depicted in FIG. 2A. As illustrated in FIG. 2B, the voltage across terminal electrodes 20 and 24 begins to collapse within 30 to 50 nanoseconds after the trigger pulse crosses the breakdown voltage threshold. The voltage between terminal electrodes 20 and 24 completely collapses to a nominal value (e.g. the internal switch loss) within 3 to 8 nanoseconds. Furthermore, as depicted, the jitter experienced by system 10 is less than 2 nanoseconds.

Illustrated in FIG. 2C is a waveform depicting the electrical current through switch 12. This current waveform is correlated in time with the trigger pulse waveform depicted in FIG. 2A and the voltage waveform depicted in FIG. 2B. The current flow commences when the voltage between terminal electrodes 20 and 24 starts to collapse, within 30 to 50 nanoseconds after the trigger pulse crosses the breakdown voltage threshold $V_b$). During the period of voltage collapse, the electrical current through switch 12 is primarily defined by the switch resistance. At the completion of the voltage collapse, 3 to 8 nanoseconds after the voltage between terminal electrodes 20 and 24 starts to collapse, the characteristics of the current through the switch, for example, the maximum current and di/dt, are a function of the impedance characteristics of load 34.

The characteristics of the trigger pulse, illustrated in FIG. 2A, are chosen to insure the electrical potential at intermediate electrode 22 initiates the sequential electrical breakdown of the medium in regions 50 and 52. The breakdown voltage, ($V_B$), is a primarily a function of the type of working gas, the pressure of the working gas and the geometry of electrodes 20, 22, and 24. In addition, the voltage at intermediate electrode 22 to confine switch 10 to an undervoltage state is primarily a function of the breakdown voltage ($V_B$), the voltage level of high voltage source 30, and the voltage level of load 34. In the illustrated embodiment, the slope of the trigger pulse, dv/dt, is generally in the order of $(V_{U-VB})/50$ nanoseconds. In addition, FIG. 2A illustrates a trigger pulse having a positive polarity, however, as described above, system 10 operates with a trigger pulse of either polarity.

FIG. 3 depicts a detailed illustration of electrodes 20, 22, and 24. In one embodiment, terminal electrodes 20 and 24 have identical geometric and compositional characteristics. Terminal electrodes 20 and 24 include a working surface 60 which is conductive and possesses appropriate sputtering properties (e.g. materials which exhibit low sputtering rates and/or result in limited contamination of the switch by sputtered products and retains good surface integrity during use), and a support assembly 62. Working surface 60 can be constructed, for example, from conductive material such as graphite, brass, stainless steel No. 316, or mixtures of tungsten and copper. Working surface 60 is mounted on support assembly 62 which secures working surface 60 to a fixed spatial location. Support assembly 62 preferably is constructed of a conductive material, for example aluminum or brass.

Intermediate electrode 22, also illustrated in FIG. 3, includes a similar working region 64, exposed on both sides, and a support assembly 66. Working region 64 is also constructed from a material which is conductive and possesses appropriate sputtering properties, and which can be the same as the materials listed above for the terminal electrodes 20 and 24. Working surface 64 is mounted on support assembly 66 which secures working surface 64 to a spatial location. Support assembly 66 preferably is constructed of a conductive material, for example aluminum or brass.

Electrodes 20, 22, and 24 preferably generate an extremely homogeneous field distribution between terminal electrode 20 and intermediate electrode 22, and likewise between terminal electrode 24 and intermediate electrode 22. The field distribution between terminal electrode 20 and intermediate electrode 22 and terminal electrode 24 and intermediate electrode 22 can be expressed in terms of the field enhancement factor (FEF). FEF is defined as the ratio of the maximum electric field strength existing in the active region between a pair of electrodes to the average electric field strength existing in that same region, prior to switch breakdown.

The terminal and intermediate electrodes are designed to provide a low FEF; that is to say, the ratio of the maximum electric field strength existing in the region between a pair of electrodes to the average electric field strength existing in that same region should approach unity. In general, electrodes having gentle curves, large radii of curvature, and large working surfaces, provide an environment for a low FEF. In addition, the working surfaces of electrodes should be substantially smooth surfaces, thus substantially eliminating areas with highly concentrated electric fields. Furthermore, providing a small gap region between the electrodes, with respect to the overall geometric configuration, decreases the FEF within gap region. Those skilled in the art, without undue experimentation, can manipulate the geometric characteristics to provide an FEF less than 1.2.

In exemplary embodiment of the present invention, a field enhancement factor of less than 1.2 can be obtained in air at atmospheric pressure by constructing electrodes as shown in FIG. 3 in an equal spaced relationship to define first and second gap regions, such gap region having a width in the order of several centimeters, and each electrode having a substantially identical geometry, a radius of curvature in the order of 10 to 100 centimeters and a working surface diameter in the range of 15 to 20 centimeters.

Figure 4:
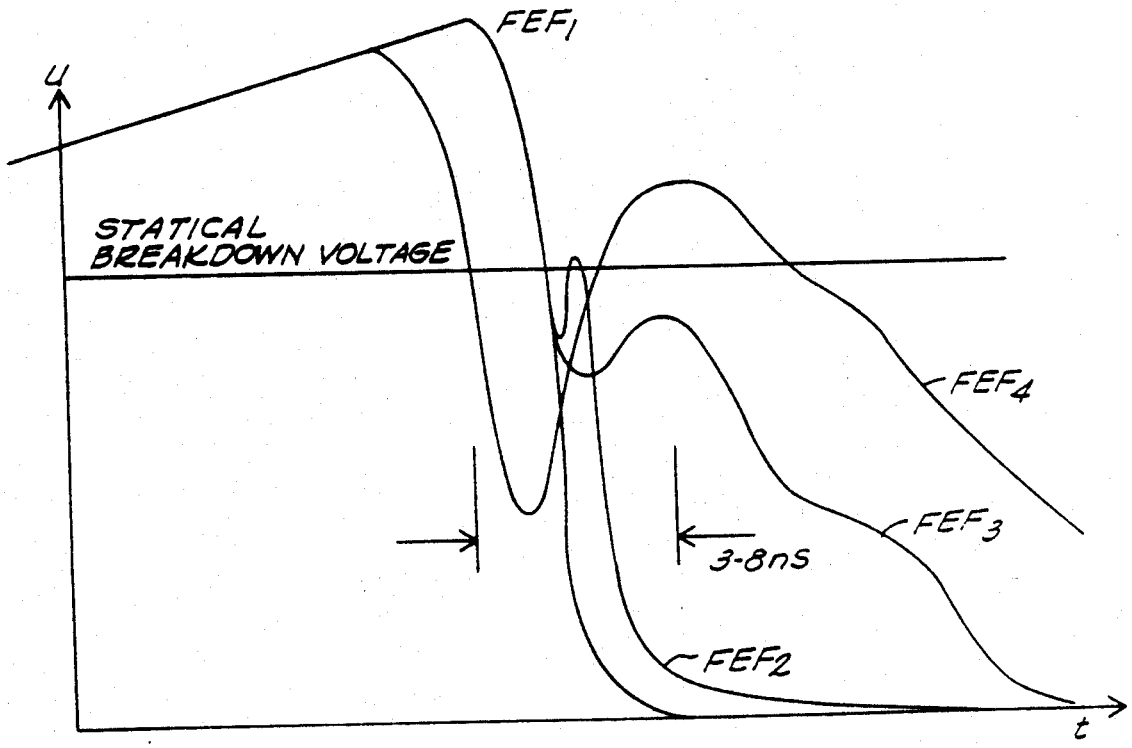
FIG. 4 is a graph illustrating the relationship of the field enhancement factor to the control of the sequential plasma discharge process in the switch of FIG. 1.

Illustrated in FIG. 4 is the interrelationship of the FEF to the controllability and predictability of the plasma discharge. The waveform labeled FEF depicts the breakdown process of the working gas in a region that has a FEF less than 1.2. Electrodes having geometric characteristics providing a FEF that is less than 1.2 provides a plasma discharge that is highly controllable and predictable. As the inhomogeneity of the electric field increases, $FEF_4 > FEF_3 > FEF_2 > FEF_1$, the uncontrollability and unpredictability of the breakdown process increases considerably.

The width of regions 50 and 52 is primarily a function of the pressure of the working gas within regions 50 and 52 the voltage to be switched. As known to those skilled in the art, as the pressure of the working gas increases the width of regions 50 and 52 can decrease. Other combinations of the pressure of the working gas within regions 50 and 52, the voltage to be switched, and the width of regions 50 and 52 are apparent to persons skilled in the art. However, the width of regions 50 and 52 need not be identical. Utilizing an asymmetrical positional relationship of electrodes 20, 22, and 24, width of region 50 not equal to the width of region 52, a deeper undervoltaging of switch 12 during the undervoltage/-hold-off state is realized. Triggering from a deeper undervoltaged state permits switch 12 to be operated at a higher repetition rate while experiencing an increase in the controllability and predictability of the plasma discharge.

Figure 5:
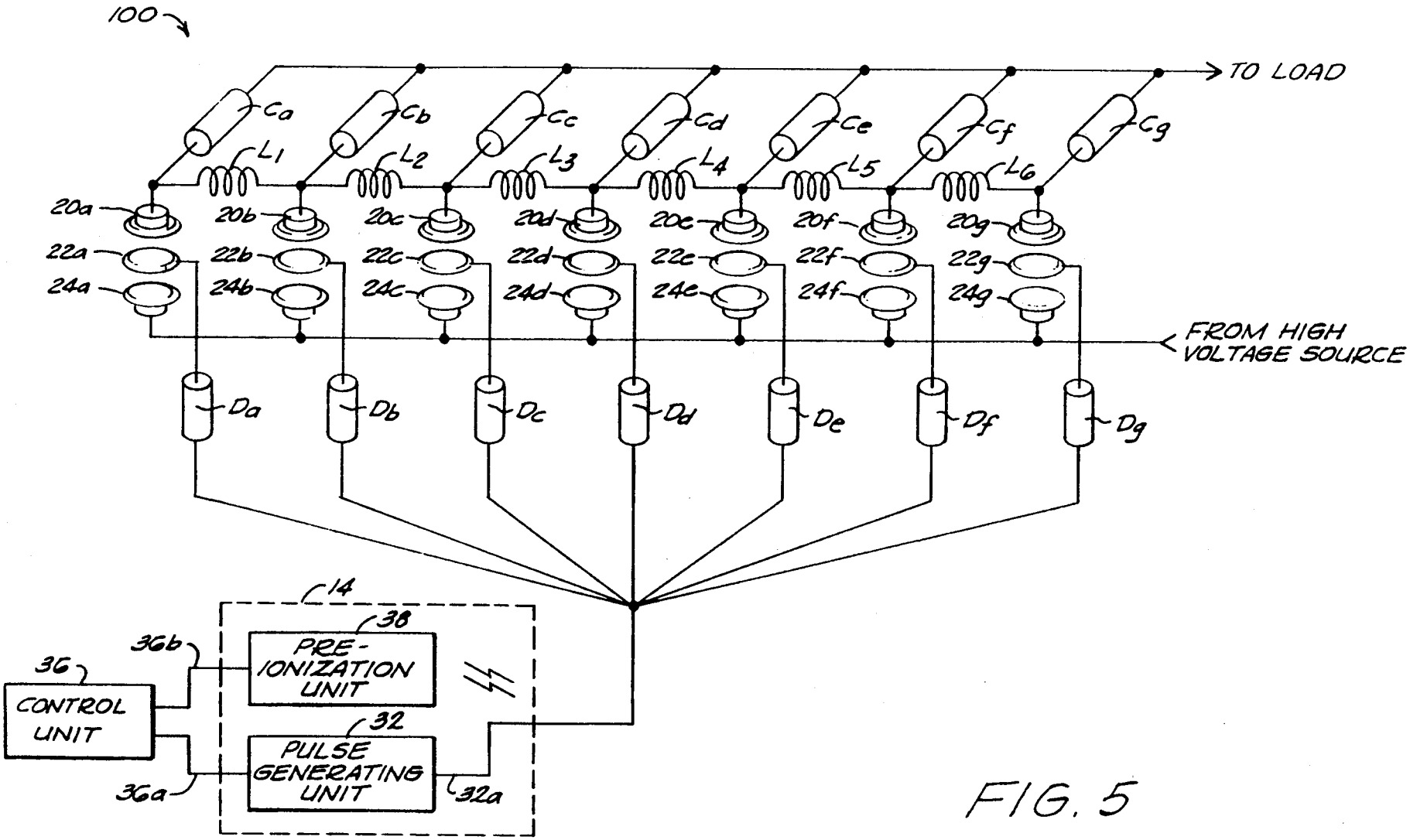
FIG. 5 is a detailed schematic block diagram of a multiple element, parallel-gap switch system in accordance with the present invention.

In FIG. 5, a parallel gap switch system 100, according to the present invention, is illustrated by a simplified electrical schematic diagram. System 100 includes a plurality of electrode pairs (20*a—g*, 22*a–g*, and 24*a–g*), a trigger unit 14, a control unit 36, a high voltage source 30, and a load 34.

Illustrated in FIG. 5, terminal electrodes 20*a–g*are electrically connected to voltage source 30. Terminal electrodes 24*a–g*are AC coupled, via C*a–g*, to load 34. In addition, terminal electrodes 20*a–g*are AC decoupled, via $L_{1-6}$, from each other.

Trigger unit 14 includes the pulse generating unit 32 and preionization unit 38, for example, an ultra violet radiation source. Pulse generating unit 32 is electrically connected via delay unit D*a–g*, to intermediate electrode 22(*a–g*). Pulse generating unit 32 is also electrically connected, via line 36*a*, to control unit 36. In addition, preionization unit 38 is electrically connected, via line 36*b*, to control unit 36.

Electrodes 20, 22, and 24 are designed to provide a substantially low FEF in an identical manner as detailed above. Furthermore, the working surfaces of electrodes 20, 22, and 24 may be constructed from the same materials as listed above.

Parallel gap switch system 100 operates in a similar manner as spark gap switch system 10. The undervoltaged and overvoltaged states for each electrode pair are identical to those described above. Furthermore, with respect to each electrode pair, the overvoltaging process is identically. However, upon application of a high voltage impulse to each intermediate electrode, each electrode pair is overvoltaged at a substantially concurrent time. Since each electrode pair is electrically connected in parallel, each electrode pair, when triggered, delivers current from source 30 to load 34 in parallel; thus a substantially larger current, with respect to a single electrode pair, is delivered to load 34.

It should be noted that the coupling capacitors (C*a–g*), decoupling inductors ($L_{1-6}$), and delay elements (D*a–g*) are ancillary to the system operation. However, these elements are utilized to enhance the overall system performance. Other configurations can utilize various alternative or ancillary electrical components, including both AC and DC coupling and decoupling inductance and capacitance elements, and delay networks (including resistive, capacitive and inductive elements) to insure substantially simultaneous current transfer and/or to otherwise enhance performance.

Although the intermediate electrode disposed between a terminal electrode pair has been described as a single electrode, the intermediate electrode may further be comprised of a plurality of intermediate electrodes disposed between a terminal electrode pair.

It should be noted that, in a parallel gap switch system 100, the slope of the trigger pulse is crucial to insure a sufficiently low jitter between the plurality of terminal electrode pairs. As detailed above and illustrated in FIG. 2A, the slope of the trigger pulse is in the range of $((V_U-V_B)/50$ nanoseconds). A slope in this range provides that each set of electrode pairs have a parallel discharge with respect to the plurality of terminal electrode pairs.

Although high voltage switch system 10 and parallel gap switch system 100 have been described as including a trigger unit 14 including a preionization unit 38 and a pulse generating unit 32, an alternative embodiment can combine the pulse generating unit and the preionization unit into a single functional element. For example, pulse generating unit 32 may perform the preionization function by employing spark or corona preionization techniques. In such a configuration, when pulse generating unit 32 generates a high voltage impulse, a spark is generated substantially simultaneously which performs the preionization function.

It should be noted that the working medium may be for example a gas selected from the group consisting of $O_2$, $N_2$, $SF_6$, air, chlorofluorocarbons, or mixtures thereof.

It should also be clear that many modifications and variations of the present invention are possible in light of the above teachings. Such additions, substitutions and other arrangements are intended to be covered by the appended claims.

What is claimed is:

1. A spark gap switch comprising:

first and second terminal electrodes disposed in a spaced apart relationship wherein said first terminal electrode is adapted for receiving a voltage from a high voltage source and said second terminal electrode is adapted for providing an electrical current to a load and whereby said terminal electrodes are capable of establishing a high voltage differential therebetween; and a trigger means including an intermediate electrode disposed between said first and second terminal electrodes and a pulse generating means for supplying an electrical pulse to said intermediate electrode to initiate sequential electrical breakdown in a first region between one of the terminal electrodes and the said intermediate electrode, and then in a second region between said intermediate electrode and the other terminal electrode, so as to permit electrical current to flow between said terminal electrodes, said electrodes configured with each having a geometry providing low field enhancement factors such that the ration of a perspective maximum electric field strength existing in said first region and in said second region to the respective average electric field strength existing in said respective region, immediately prior to said current flow, is low.

2. The switch of claim 1 wherein the first and second terminal electrodes have substantially smooth surfaces.

3. The switch of claim 2 wherein the first and second terminal electrodes each have substantially circular geometry.

4. The switch of claim 2 wherein the first and second terminal electrodes have planar surfaces which are substantially parallel to each other.

5. The switch of claim 4 wherein the first and second terminal electrodes, and intermediate electrode have active surface areas greater than about $25cm^2$.

6. The switch of claim 4 wherein the first and second terminal electrodes, and intermediate electrode have active surface areas greater than about $50cm^2$.

7. The switch of claim 2 wherein intermediate electrode has a substantially smooth surface.

8. The switch of claim 7 wherein the substantially planar intermediate electrode has a substantially circular geometry.

9. The switch of claim 7 wherein the substantially planar intermediate electrode is parallel to said first and second terminal electrodes.

10. The spark gap switch of claim 9 wherein the first and second terminal electrodes, and intermediate electrode have a geometry providing field enhancement factors less than or equal to 1.2.

11. The switch of claim 1 wherein the first and second terminal electrodes, and intermediate electrode have a geometry providing field enhancement factors less than or equal to 1.2.

12. The switch of claim 1 wherein the switch further comprises an enclosure means for containing a gas medium wherein the first and second terminal electrodes, and intermediate electrodes are disposed within said medium.

13. The switch of claim 12 wherein said gas mixture is selected from the group consisting of $O_2$, $N_2$, $SF_6$, air, chlorofluorocarbons, or mixtures thereof.

14. The switch of claim 12 wherein the gas medium is maintained at a pressure ranging from about 500 to 8000 Torr.

15. The switch of claim 12 wherein the gas medium is maintained at a pressure ranging from about 1000 to 3000 Torr.

16. The switch of claim 1 wherein the electrodes are disposed within a medium and the triggering means further includes preionization means for preionizing said medium.

17. The switch of claim 16 wherein the preionization means further includes an ultra-violet radiation source.

18. The switch of claim 1 wherein the switch further comprises a plurality of intermediate electrodes.

19. A parallel gap switch system comprising:

an array of terminal electrode pairs including a plurality of first terminal electrodes electrically connected in parallel for receiving a voltage from a high voltage source and a plurality of second terminal electrodes electrically connected in parallel for providing an electrical current to a load;

a trigger means including at least one intermediate electrode disposed between said first terminal electrodes and said second terminal electrodes, and a pulse generating means for supplying an electrical pulse to said intermediate electrode to initiate parallel sequential electrical breakdown in a first region between at least a portion of one of the pluralities of terminal electrodes and said intermediate electrode, and then in a second region between the intermediate electrode and at least a portion of the other of the plurality of terminal electrodes, so as to permit electrical current to flow between the terminal electrodes, said electrodes configured with each having a geometry providing low field enhancement factors such that the ratio of a respective maximum electric field strength existing in said first region and in said second region to the respective average electric field strength existing in said respective region, immediately prior to said current flow, is low.

20. The parallel gap switch system of claim 19 wherein the system further comprises a plurality of intermediate electrodes disposed between each terminal electrode pair.

21. The switch of claim 19 wherein the first and second terminal electrodes have substantially smooth surfaces.

22. The switch of claim 21 wherein the first and second terminal electrodes have substantially circular geometry.

23. The switch of claim 21 wherein the planar surfaces of the first and second terminal electrodes are substantially parallel to each other.

24. The switch of claim 23 wherein the first and second terminal electrodes, and intermediate electrode have active surface areas greater than about $25cm^2$.

25. The switch of claim 23 wherein the first and second terminal electrodes, and intermediate electrodes have active surface areas greater than about $50cm^2$.

26. The switch of claim 21 wherein intermediate electrode has a substantially smooth surface.

27. The switch of claim 26 wherein the substantially planar intermediate electrode has a substantially circular geometry.

28. The switch of claim 26 wherein the substantially planar intermediate electrode is parallel to said first and second terminal electrodes.

29. The switch of claim 28 wherein the first and second terminal electrodes, and intermediate electrode have a geometry providing field enhancement factors less than or equal to 1.2.

30. The switch of claim 19 wherein the switch further comprises an enclosure means for containing a gas medium wherein the first and second terminal electrodes, and intermediate electrodes are disposed within said medium.

31. The switch of claim 30 wherein said gas mixture is selected from the group consisting of $O_2$, $N_2$, $SF_6$, air, chlorofluorocarbons, or mixtures thereof.

32. The switch of claim 30 wherein the gas medium is maintained at a pressure ranging from about 500 to 8000 Torr.

33. The switch of claim 30 wherein the gas medium is maintained at a pressure ranging from about 1000 to 3000 Torr.

34. The switch of claim 19 wherein the electrodes are disposed within a medium and the triggering means further includes preionization means for preionizing said medium.

35. The switch of claim 34 wherein the preionization means further includes an ultra violet radiation source.

36. The spark gap switch of claim 19 wherein the first and second terminal electrodes, and the intermediate electrodes having a geometry providing field enhancement factors less than or equal to 1.2.

* * * * *